US006779742B2

(12) United States Patent
Kitajima

(10) Patent No.: US 6,779,742 B2
(45) Date of Patent: Aug. 24, 2004

(54) AIR BRUSH

(75) Inventor: Katsuaki Kitajima, Nagano-Ken (JP)

(73) Assignee: B.B. Rich Co., Ltd., Nagano-ken (JP)

( * ) Notice: Subject to any disclaimer, the term of this patent is extended or adjusted under 35 U.S.C. 154(b) by 0 days.

(21) Appl. No.: 10/309,289

(22) Filed: Dec. 4, 2002

(65) Prior Publication Data

US 2004/0016823 A1 Jan. 29, 2004

(30) Foreign Application Priority Data

Jul. 24, 2002 (JP) ..... 2002-215381

(51) Int. Cl.[7] ..... B05B 1/28

(52) U.S. Cl. ..... 239/290; 239/414; 239/417.3; 239/329; 239/353; 239/345; 137/626; 251/285

(58) Field of Search ..... 239/290, 291, 239/415, 414, 417.3, 379, 353, 345, 377; 137/613, 626, 636; 251/285, 246

(56) References Cited

U.S. PATENT DOCUMENTS 2,370,486 A * 2/1945 Paasche ..... 239/319
4,798,336 A * 1/1989 Ilott ..... 239/337
6,105,881 A * 8/2000 Kitajima ..... 239/353

* cited by examiner

*Primary Examiner*—Dinh Q. Nguyen
(74) *Attorney, Agent, or Firm*—Bacon & Thomas PLLC

(57) ABSTRACT

In contrast to the conventional air brush, an air brush in the invention has a function in which even a beginner can easily perform an operation for pulling an operating rod little by little while the operating rod is slightly pushed and pulled at an initial stage of the drawing of a line requiring a technique and an experience. The operating rod arranged in an air brush main body forms a slanting face therein projected on the front face of this operating rod while the slanting face is inclined from below to above, and this slanting face abuts on the front side edge of a notch port of the air brush main body. An air valve is opened every small amount and a needle is simultaneously retreated every small amount in a range in which the slanting face of the operating rod and the front side edge of the notch port come in contact with each other and are slid at the initial stage of an operation for pushing and moving the operating rod. Anybody can simply perform the initial operation of line drawing by only pushing the operating rod.

6 Claims, 12 Drawing Sheets

AIR BRUSH

BACKGROUND OF THE INVENTION

1. Field of the Invention

This invention relates to an improvement of the blowing-out characteristics of an air brush, and more particularly, relates to an air brush able to blow-out paint ejected from a nozzle from a starting point to the line of a predetermined width at the beginning of writing of the line so as to be naturally transferred, and able to easily perform a basic operation of the air brush for completely writing the line even by a beginner while the line is naturally tapered from the line of a predetermined width.

2. Description of the Related Art

FIGS. 11 and 12 show a conventional air brush 100. This air brush 100 has an air brush main body 101 having a nozzle 102 at its tip and approximately formed in a long sleeve shape.

A needle 103 is inserted along a shaft core portion within the air brush main body 101 so as to be freely advanced and retreated. The air brush 100 is constructed such that a compressed air is supplied to an air supply port 104 connected to an intermediate portion of the air brush main body 101, and is introduced to an air passage path 112 within the air brush main body 101 through an air valve 105, and is blow out of the above nozzle 102. The above air valve 105 has a structure in which the air valve 105 is opened by pushing a valve rod 105*a*.

In the air brush 100, an operating rod 106 is fitted and mounted to a notch port 121 notched and formed in the intermediate portion on the upper face of the air brush main body 101. A pushing rod 108 is connected to a lower end portion of this operating rod 106 through a pivotal shaft 107 so as to be freely bent. The pushing rod 108 is supported such that the pushing rod 108 is inserted and fitted into an insertion hole 109 bored within the air brush main body 101 so that the pushing rod 108 is slid in the axial direction together with the operating rod 106. A tip portion of the above pushing rod 108 abuts on the tip of the valve rod 105*a* of the air valve 105. An operating button 106*a* for placing a finger is arranged at the upper end of the above operating rod 106.

On the other hand, the valve rod 105*a* is mounted into a connecting sleeve 110 as an air supply port, and is upward biased at any time by the biasing force of a coil spring 111, thereby maintaining a state (valve closing state) in which an upper end portion of the above valve rod 105*a* abuts on the tip of the pushing rod 108 (FIGS. 11 and 12).

When a user pushes down the operating rod 106 of the above air brush 100, the valve rod 105*a* is pushed down through the pushing rod 108 so that the air valve 105 is opened. Thus, the compressed air is supplied into the air brush main body 101 from a supply source of the compressed air connected to the above connecting sleeve 110, and is ejected from the nozzle 102 through the air passage path 112.

When the user pulls the operating rod 106 pushed down as mentioned above backward as it is and is tilted with the pivotal shaft 107 as a fulcrum, the needle 103 gripped and supported by a needle chuck 113 is retreated, and the paint supplied from a container 112 for paint is sprayed and ejected by the ejection of the compressed air. The operation for pushing and then pulling the operating rod 106 as mentioned above is called a double action, and this double action is a basic operation in the use of the air brush.

When a thin line is drawn by using the above conventional airbrush 100, the air is blown out of the nozzle 102 by slightly pushing-down the operating rod 106. Next, a small amount of paint is supplied to the nozzle 102 by slightly pulling the operating rod 106 while this operating rod 106 is pushed. Thus, a line gradually widened in width from a starting point is written. Namely, as mentioned above, the double action as the basic operation of the air brush is taken. The blowing-out of the paint is increased by further pulling the operating rod from the above state so that a thick line can be drawn.

Thus, when the line is drawn by using the air brush 100, a write-beginning portion of the line is gradually thickened from the starting point and a constant thick line is formed by slightly pulling the operating rod 106 while the operating rod 106 is very slightly pushed. However, the operation of pulling the operating rod 106 little by little while the operating rod 106 is pushed little by little, is an operation requiring concentration force even in a veteran.

Accordingly, it is difficult for a person never using the air brush or a beginner to smoothly perform the above operation of the operating rod. Since no adjustment of pushing and pulling degrees of the operating rod is first known, the paint is brown out at once at the write-beginning inmost cases, thereby resulting in a failure.

The operation of the operating rod of the air brush is gradually progressed by repeating practice. However, when the beginner first fails in this operation, it seems very difficult to use the air brush. As a result, there is also a case in which weak consciousness is caused in the use of the air brush, and the use (the drawing of a work by using the air brush) of the air brush itself is abandoned.

On the other hand, when the operating rod is operated as mentioned above, the paint begins to be ejected after the air is first blown out. When this operation is reversely performed, the paint is blown off by the air after the paint is collected in the nozzle. Therefore, the paint is ejected at a stroke at the starting point of the line, thereby resulting in a failure.

After the line is written, the blowing-out of the air is stopped after the ejection of the paint is stopped. When this operation is reversely performed, the paint is left in the nozzle after the blowing-out of the air is stopped. Therefore, in the next blowing-out, the paint left in the nozzle is brown out at a stroke.

In contrast to the above conventional airbrush, an object of the present invention is to provide an air brush having a function in which even a beginner can easily perform an operation for pulling the operating rod (ejecting the paint) little by little while the operating rod is slightly pulled (the air is ejected) at an initial stage of the drawing of a line requiring a technique and an experience.

SUMMARY OF THE INVENTION

To solve the above problems, in the air brush of the present invention, a needle is inserted in the axial direction along a shaft core portion of an air brush main body having a nozzle at its tip so as to be advanced and retreated. The amount of paint ejected from the nozzle is adjusted by advancing and retreating this needle.

An air valve is arranged within the air brush main body, and a compressed air supplied through this valve is blown out of the above nozzle. An operating rod is fitted into a notch port formed in the air brush main body, and a pushing rod is connected through a pivotal portion arranged at the lower end of this operating rod so as to be freely bent. This pushing rod is fitted into the air brush main body, and is supported together with the above operating rod so as to be freely vertically pushed and moved.

Since the lower end of the above pushing rod and the upper end of a valve rod for opening and closing the air valve are opposed to each other, the air valve is opened by pushing and moving the valve rod by pushing the operating rod so that the compressed air is supplied to the nozzle. The amount of the air supplied to the nozzle, i.e., the blowing-out amount is approximately proportional to the pushing amount of the above operating rod.

On the other hand, when the above operating rod is tilted backward, the needle is retreated in cooperation with an engaging body mounted within the notch port of the air brush main body. The nozzle is opened by retreating the needle, and the paint supplied by blowing-out the air is sprayed.

A slanting face projected while the slanting face is inclined from below to above, is formed on the front face side of the above operating rod. This slanting face abuts on an abutting portion of a front side edge of the notch port of the air brush main body.

The air valve is pushed and opened little by little and the needle is simultaneously retreated little by little in a range in which the slanting face of the operating rod and a contact portion arranged at a front side edge of the notch port come in contact with each other and are slid at the initial stage of an operation for pushing and moving the operating rod.

Namely, at the initial stage of the operation of the operating rod, a user can increase the amount of the air ejected from the nozzle and the amount of the paint supplied to the nozzle little by little from zero by only slightly pushing the operating rod. Thus, even a beginner can simply express the beautifulness of a line naturally enlarged from a starting point and conventionally considered as the technique of a veteran by a little exercise.

In the gist of the air brush according to claim 2, a slanting face projected while the slanting face is inclined from below to above, is formed on the rear face of the operating rod fitted into the notch port of the air brush main body. This slanting face abuts on the engaging body mounted within the notch port of the air brush main body.

The air valve is pushed and opened little by little and the needle is simultaneously retreated little by little in a range in which the slanting face on the operating rod rear side and the engaging body mounted within the notch port come in contact with each other and are slid at the initial stage of the operation for pushing and moving the above operating rod.

Thus, at the initial stage of the operation of the operating rod, the user can increase the amount of the air ejected from the nozzle and the amount of the paint supplied to this nozzle little by little from zero by only slightly pushing the operating rod. Thus, even a beginner can express the beautifulness of a line naturally enlarged from a starting point and considered so far as the technique of a veteran.

In the gist of the air brush according to claim 3, slanting faces projected while the slanting faces are inclined from below to above, are respectively formed on the front and rear faces of the operating rod fitted into the notch port of the air brush main body. A front side edge contact portion of the slanting face on this operating rod front side and the notch port, and the engaging body fitted and mounted into the notch port abut on each other.

The user pushes and opens the air valve every small amount and simultaneously retreats the needle every small amount in a range in which a front side edge contact portion of the slanting face on the operating rod front side and the notch port, and the engaging body fitted and mounted to the notch port come in contact with each other and are slid at the initial stage of the operation for pushing and moving the operating rod.

Thus, at the initial stage of the operation of the operating rod, the user can increase the amount of the air ejected from the nozzle and the amount of the paint supplied to this nozzle little by little from zero by only slightly pushing the operating rod. Thus, the beautifulness of a line naturally enlarged from a starting point can be expressed.

In the air brush according to claims 4–6, a timing stroke for making the ejection of the air precede the supply of the paint in the pushing of the operating rod, and delaying the ejection of the air with respect to the supply stoppage of the paint in release of the pushed operating rod is arranged below the slanting face in the above operating rod. Accordingly, when the operating rod is pushed, the blowing-out of the air is precedently performed in the range of the above timing stroke at the initial stage of this operation of the operating rod, and the paint is then ejected. Thus, the phenomenon that the paint collected in the nozzle is blown off at a stroke by the air, can be prevented by delaying the supply of the paint in comparison with the ejection of the air.

Further, the supply of the paint is stopped in the stoppage of the blowing-out of the paint. After the supply of the paint to the nozzle is stopped by the delay using the timing stroke, the blowing-out of the air is stopped with an instant delay. Thus, no paint is left in the nozzle, and no paint left in the nozzle is blown out at a stroke in the next use.

DESCRIPTION OF THE PREFERRED EMBODIMENT

One embodiment of the present invention will next be explained on the basis of the drawings.

Figure 1:
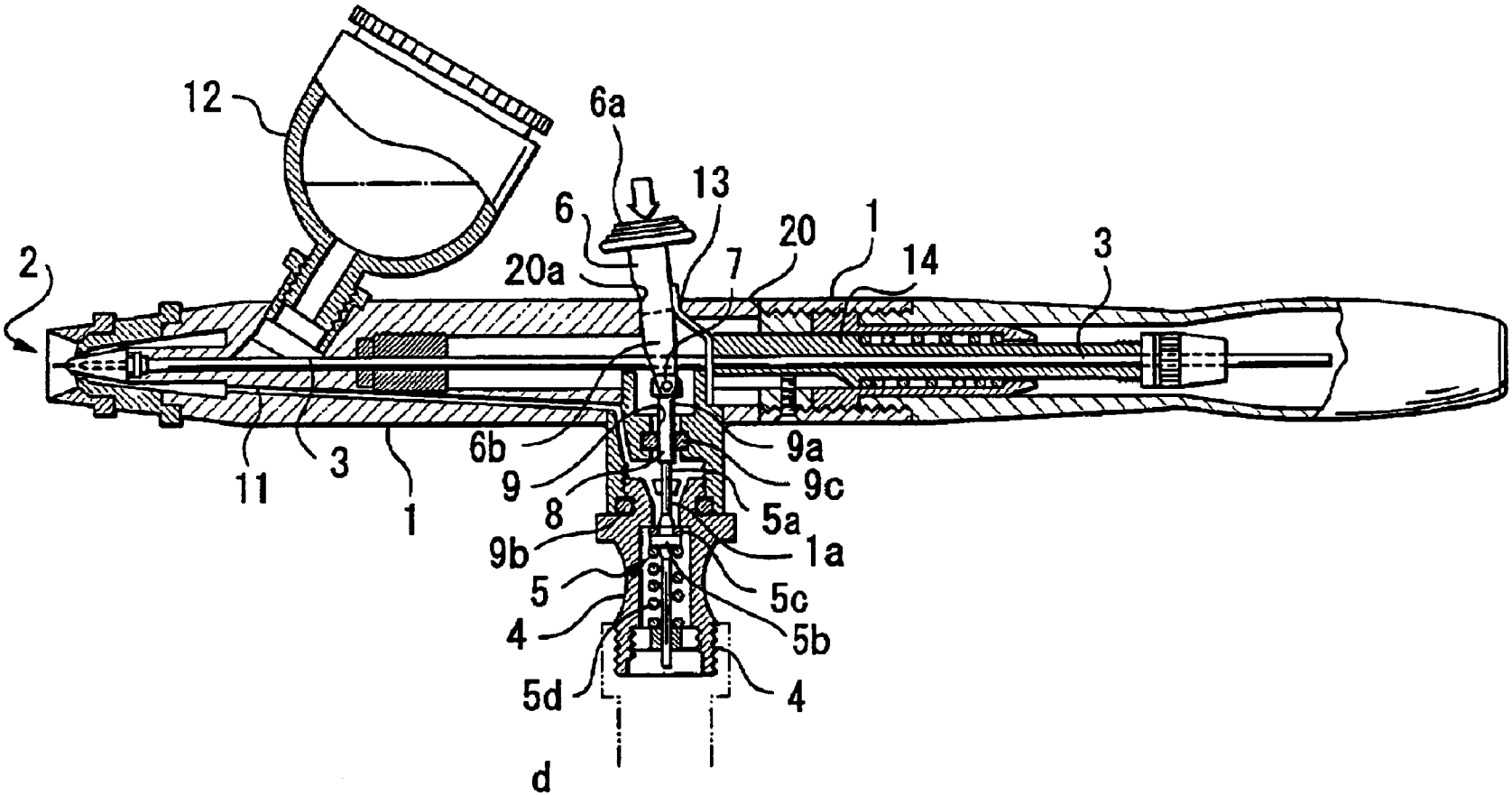
FIG. 1 is a longitudinal sectional side view showing an air brush in which the present invention is embodied.
Figure 3:
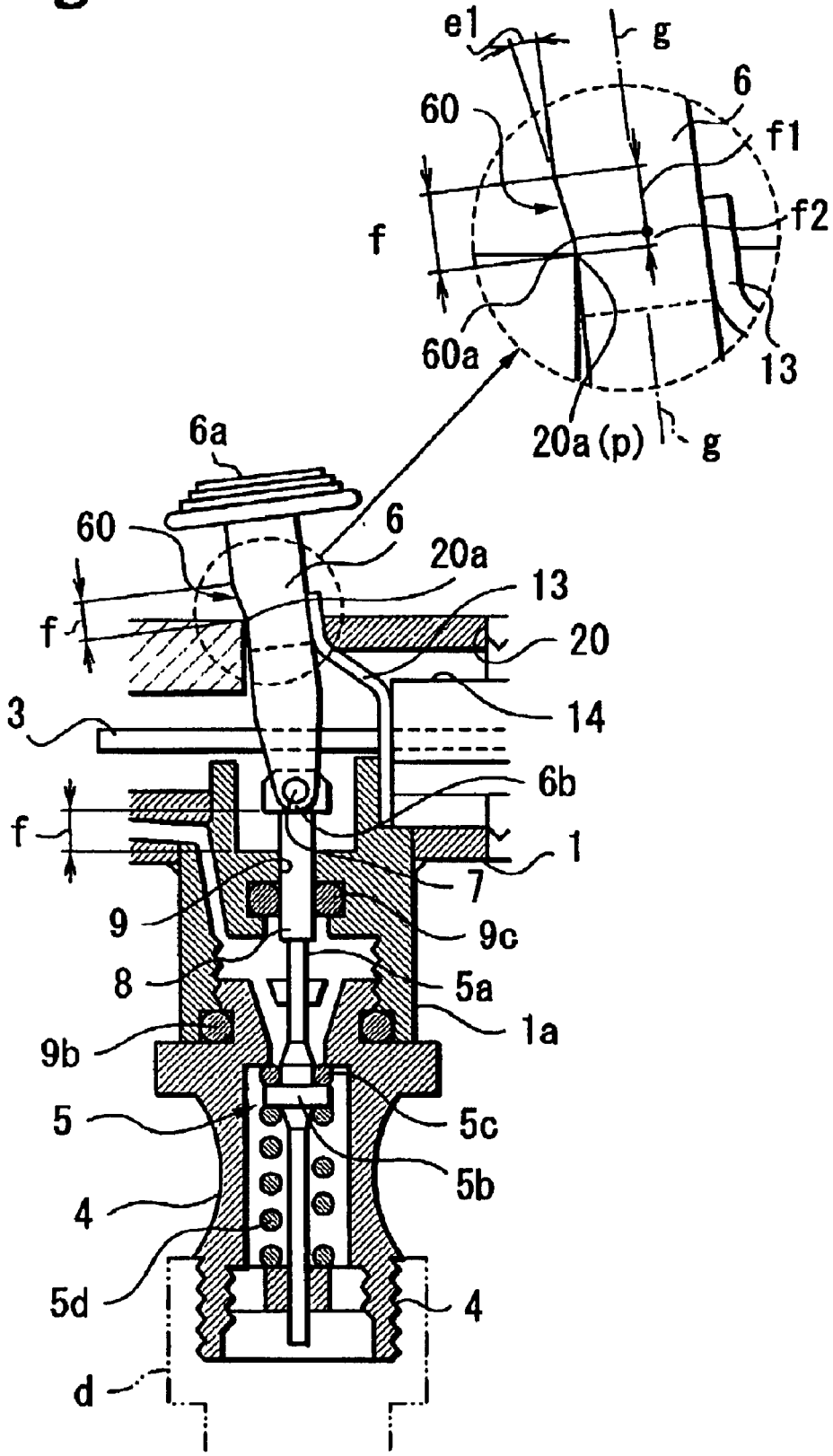
FIG. 3 is a longitudinal sectional side view showing an operating rod portion of the air brush in a slight pushing state of the operating rod.

In an air brush shown in FIGS. 1 and 3, a nozzle 2 as a blowing-out portion of a compressed air and a liquid paint is arranged at the tip of an air brush main body 1 approximately formed in a cylindrical shape. A needle 3 for arbitrarily opening and closing the above nozzle 2 is inserted along a shaft core portion of the above air brush main body 1 so as to be slidably advanced and retreated.

The needle 3 is retreated by an operation for pushing and pulling the above operating rod 6. Thus, the liquid paint supplied from a container 12 attached to the front portion of the air brush main body 1 is blown out of the nozzle 2 and is sprayed together with the compressed air supplied through an air valve 5 described later.

A connecting sleeve 4 as a connecting port of a compressed air supply hose d is screwed and connected to an intermediate portion of the above air brush main body 1, and the air valve 5 is arranged within the connecting sleeve 4.

In the air valve 5, a valve body 5*b* is separated from a valve seat 5*c* and is opened by downward pushing and moving a valve rod 5*a* integrally having the valve body 5*b*. The compressed air is flowed into the air brush main body 1 from a lower end port of the connecting sleeve 4 as an air supply port by opening the above air valve 5, and is blown out of the nozzle 2 through an air passage path 11 arranged within this main body 1.

The valve rod 5*a* of the above air valve 5 is biased upward, i.e., on the valve closing side at any time by a coil spring 5*d* elastically mounted to the lower face side of the valve body 5*b*. Thus, the tip of the upper side of the above valve rod 5*a* maintains an upward projecting state in the shaft core portion within a forked portion 1*a* integrally molded with a central lower portion of the air brush main body 1 (FIG. 3).

On the other hand, a notch port 21 is notched and formed in the upper portion of the central portion of the air brush main body 1 corresponding to an extension line of the above valve rod 5*a*. The operating rod 6 is fitted and mounted to this notch port 21 so as to be pushed and moved.

An operating button 6*a* engaged with a finger is arranged in an upper end portion of the operating rod 6 as a basic end. The upper end of a pushing rod 8 is connected to a lower end portion of the operating rod 6 as a fitting insertion tip through a pivotal shaft 7.

Figure 2:
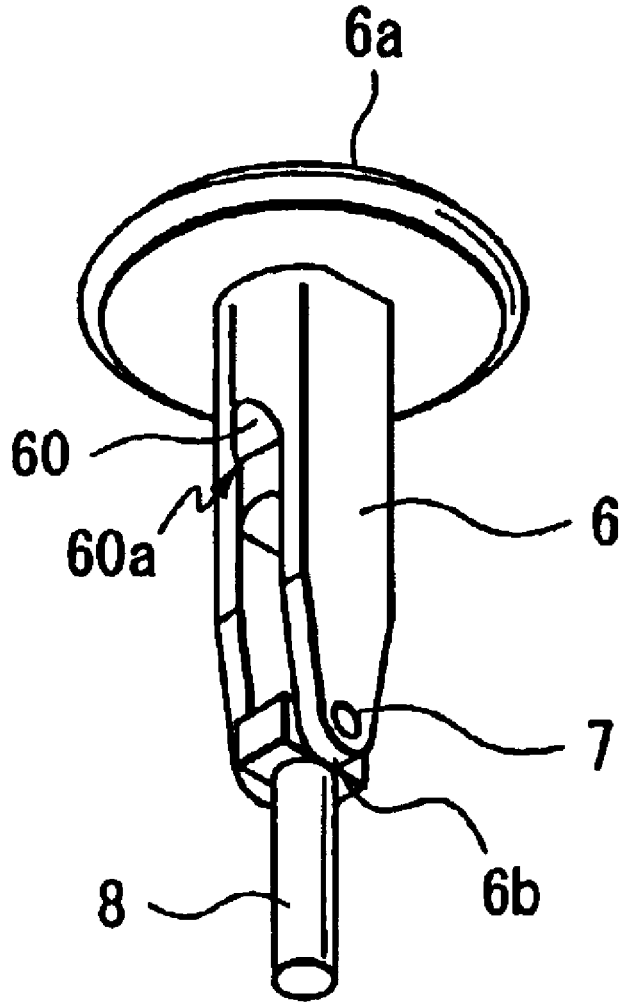
FIG. 2 is a perspective view showing an operating rod of this air brush.

As shown in FIG. 2, the lower portion 6*b* of the operating rod 6 is formed to have a slightly small diameter, and is also formed in a fork-branching shape so as to extend the needle 3 through the lower portion 6*b*. A connecting portion of both these members 6 and 8 is bent through the pivotal shaft 7 by inserting a pin as the pivotal shaft 7 into the lower portion 6*b* in a state in which the upper portion of the pushing rod 8*is* inserted between the lower portions of the branching portion approximately rounded in a semicircular shape seen from its side.

Figure 4:
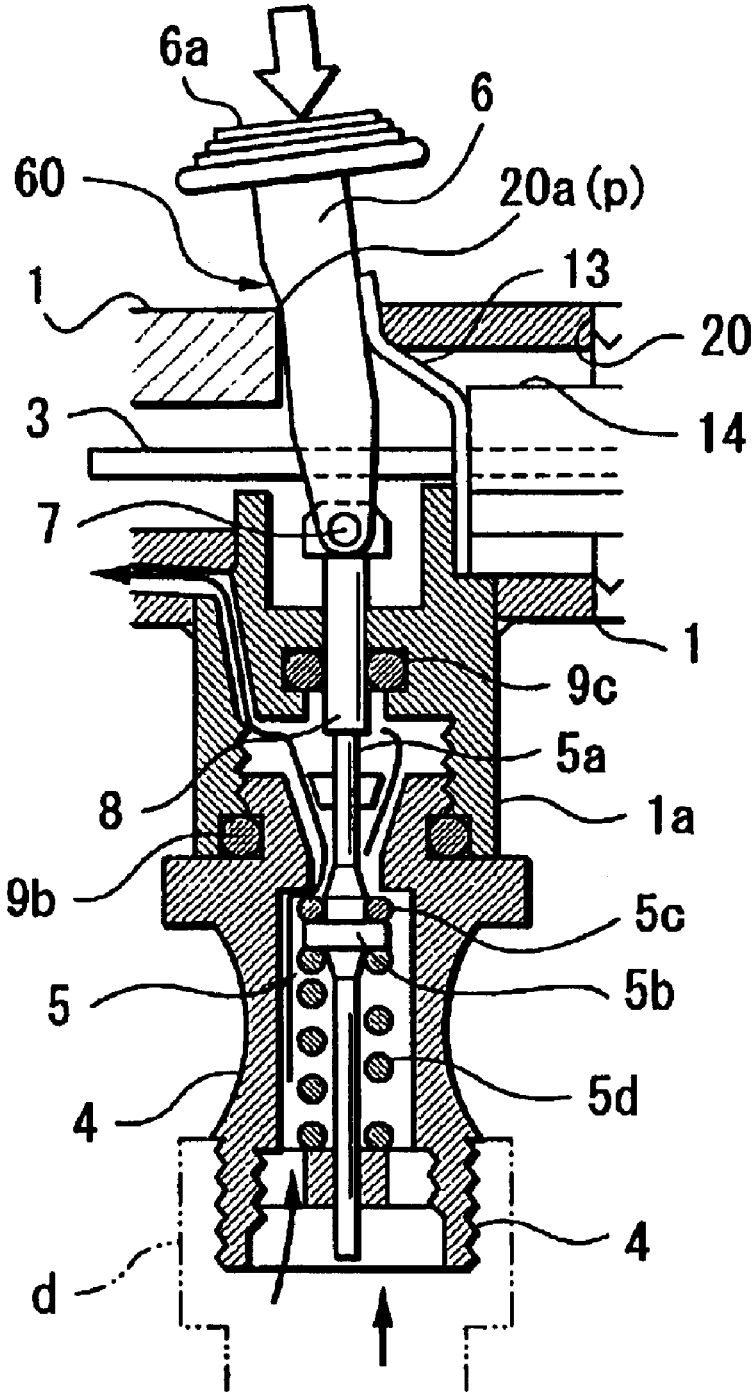
FIG. 4 is a longitudinal sectional view showing the operating rod portion of this air brush and shows a state in which the operating rod is pushed until the middle.

The pushing rod 8 is a shaft body slidably fitted and inserted into an insertion hole 9 bored in the shaft core portion of the forked portion 1*a* of the air brush main body 1. A packing 9*c* for airtight is fitted and mounted into the insertion hole 9. The pushing rod 8 is fitted and inserted into the insertion hole 9 from the upper end side, and its lower end abuts on a tip portion of the above valve rod 5*a*. Accordingly, the pushing rod 8 and the operating rod 6 are supported by the valve rod 5*a* from below at a normal time. At a using time, the operating rod 6 is pushed down against the biasing force of the coil spring 5*d* and the air valve 5 is opened (FIG. 4).

Figure 5:
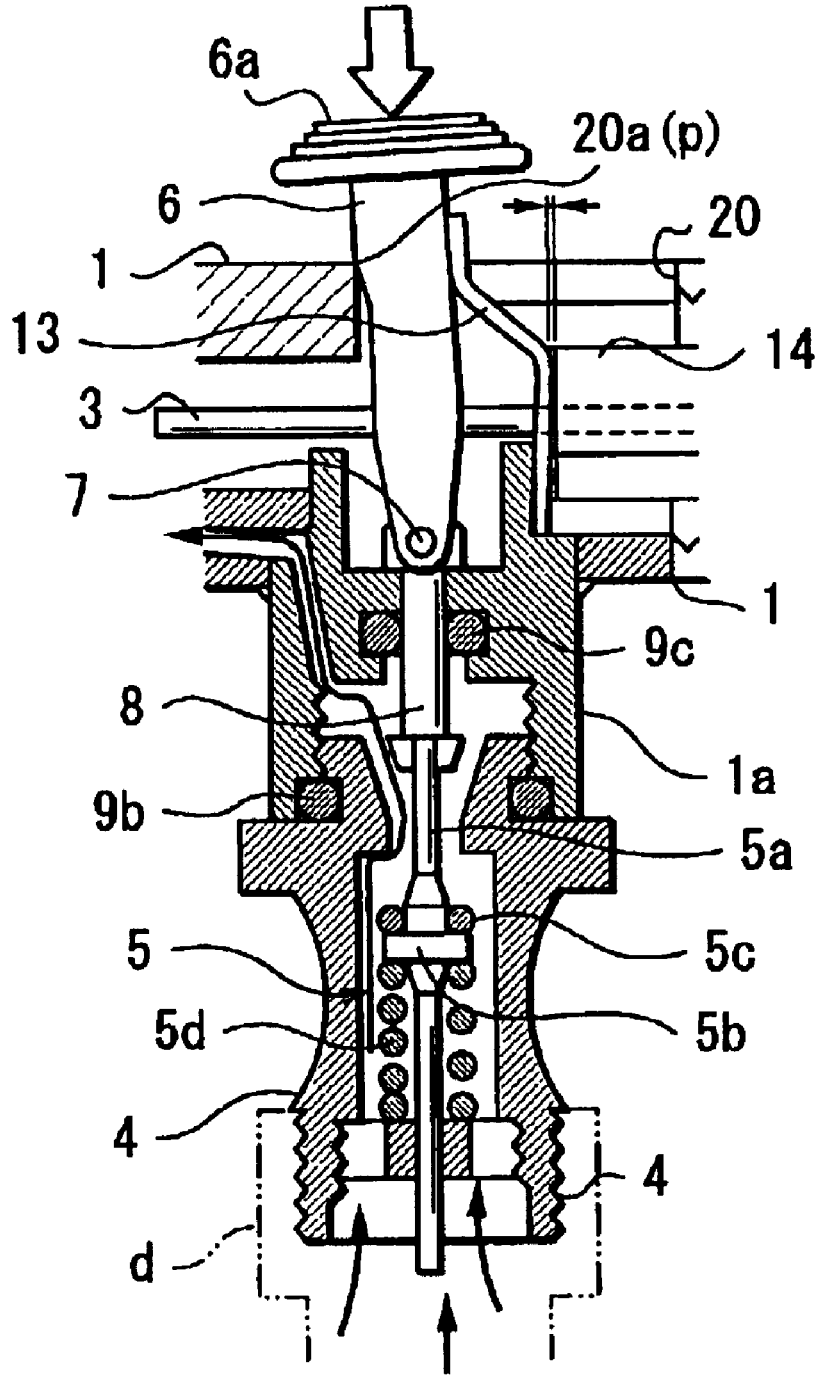
FIG. 5 is a longitudinal sectional view showing the operating rod portion of this air brush and shows a state in which the operating rod is pushed until its lower end.

When the operating rod 6 is pushed down, the pushing rod 8 is pushed into the insertion hole 9, and the tip portion of the operating rod lower portion 6*b* rounded in an arc shape abuts on an end face 9*a* formed around an upper side end of the insertion hole 9. Thus, the operating rod 6 attains a state in which no operating rod 6 can be pushed any more (FIG. 5).

Accordingly, when a user pushes the operating button 6*a* of the operating rod 6, the pushing rod 8 connected to the tip of the operating rod 6, and the valve rod 5*a* abutting on the tip of this pushing rod 8 are pushed downward. Thus, the valve body 5*b* is separated from the valve seat 5*c* and the air valve 5 is opened.

When the air valve 5 is opened, the compressed air supplied from the compressed air supply hose d connected to an air supply port 4 is introduced to the air passage path 11 within the air brush main body 1, and is blown out of the nozzle 2. In the normal use, there are many cases in which a state for maximizing the air blowing-out is maintained by pushing-down the above operating rod 6 until its lowermost portion.

The pushed-down operating rod 6 is pulled backward and is tilted backward by a required amount with the pivotal shaft 7 as a fulcrum so as to eject paint. An operating plate 13 approximately bent in an S-shape is tilted by tilting the operating rod 6, and a chuck 14 for gripping and supporting the needle 3 is retreated. A predetermined desirable amount of paint is supplied toward the nozzle 2 by retreating the needle 3, and is formed in a spray shape by the blowing-out of the compressed air already blown-out, and is blown out of the nozzle 2 and is sprayed.

Namely, when a line is drawn, the thickness of the line and the density of color are adjusted by adjusting the pushing and pulling amounts of the operating rod 6.

As mentioned above, the operating for lowering the operating rod 6 and then backward pulling the operating rod 6 is called a double action.

It may be said that the air brush explained above has a structure similar to that of the normal air brush. The air brush of the present invention is characterized in the above operating rod 6.

As shown in FIGS. 2 and 3, a slanting face 60 is formed on the front face of the operating rod 6. The slanting face is formed in an intermediate portion of the front face of the operating rod 6, and is formed so as to be projected while the slanting face is inclined from below to above (FIG. 3).

The above slanting face 60 is inclined at an inclination angle (e1) of 11° with a central line g of the operating rod 6 as a reference. When the operating rod 6 is pushed, its surface abuts on a front side edge 20*a* of the notch port 21 and is slid. In the air brush of this embodiment, the length of the slanting face 60 in the vertical direction is set to approximately range from 1.5 mm to 2.5 mm (f1). Further, in the mounting state of the operating rod 6, a part as a contact portion p with the front side edge 20*a* of the notch port 21 is set such that this part is located in a position lower by about 0.3 to 0.5 mm (timing stroke f2) than the lower end of the above slanting face 60 (FIG. 3) There is a relation of slanting face 60 length (f1)+(timing stroke f2)=pushing-down stroke (f).

When the air brush constructed above is used, an index finger is lightly placed on the operating button 6*a* attached to the upper end of the operating rod 6, and is softly pushed down. Thus, the contact portion p of the front face of the operating rod 6 and the front side edge 20*a* of the notch port 21 is lowered by the timing stroke f2 (0.5 mm) and is then moved to the lower end of the above slanting face 60, and is slid until the uppermost portion of this slanting face 60 as it is.

Namely, the operating rod 6 is lowered by the timing stroke f2 (0.5 mm) at the initial stage of the pushing-moving operation, and only the air is first ejected. Next, when the contact portion p is moved onto the slanting face 60 from a lower end portion 60*a* of the slanting face 60, the operating rod 6 is pushed backward in proportion to a projecting amount of this slanting face 60 (FIG. 5). Thus, the operating rod 6 is retreated backward (automatically pulled) little by little with the pivotal shaft 7 as a fulcrum. As the needle 3 is retreated, a very small amount of paint begins to be ejected and this paint is gradually thickened and a line thickness as an object is attained.

When the pushed operating rod 6 is reversely returned, the contact portion p is moved downward from the upper end of the slanting face 60. When this contact portion p reaches the lower end portion 60*a*, the needle 3 is moved most forward and the supply of the paint is first stopped. Then, the ejection of the air is stopped by lowering the contact portion p by the timing stroke f2 from the lower end portion 60*a*.

As mentioned above, in the air brush of the present invention, the technique conventionally performed by only a veteran, i.e., the technique at the initial stage of a spraying operation for slightly pulling-in the operating rod 6 while the operating rod 6 is slightly pushed down, can be easily used by anybody by only lightly pushing-down the operating rod 6 of the upper portion of the air brush main body 1 by the stroke f.

As mentioned above, when the operating rod 6 is pushed-down by the stroke f and the contact portion p is moved until the uppermost portion of the slanting face 60, the supply of the air is approximately maximized. When the operating rod 6 is pulled-in backward from this state, the supply amount of the paint is increased and the thickness of a drawn line can be arbitrarily adjusted.

In contrast to this, when the drawing of the line is stopped, the pulled-in operating rod 6 is returned and the finger is separated from the pushed button 6*a*. Thus, the ejection of the paint is first stopped and the ejection of the air is stopped just after this ejection of the paint.

As mentioned above, when the paint is ejected, the paint is supplied to the nozzle after the air is ejected. When the ejection of the paint is reversely stopped, the ejection of the air is stopped after the supply of the paint is stopped. This construction is important and the arrangement of the timing stroke f2 just below the slanting face 60 of the operating rod 6 enables this construction.

Namely, the disadvantage that the paint collected in the nozzle is ejected at a stroke by the ejection of the air beginning to be blown can be prevented by securing the timing stroke. It is also possible to reliably dissolve the disadvantage that the paint collected in the nozzle in the previous use is ejected at a stroke together with the blowing-out of the air at the next using time.

Figure 6:
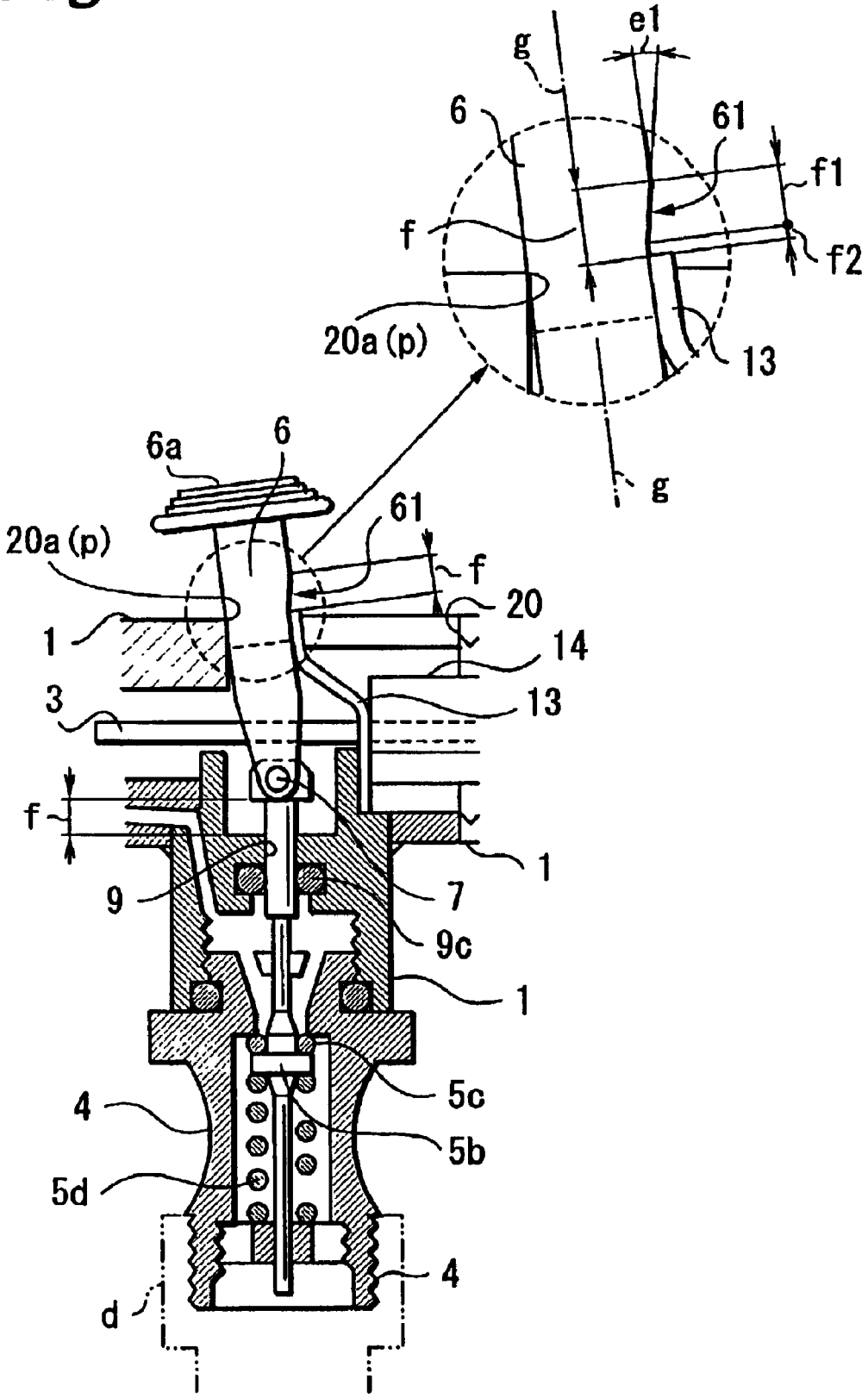
FIG. 6 is a longitudinal sectional view showing the operating rod portion of the air brush in which a slanting face is arranged on the rear side of the operating rod.

The air brush shown in FIG. 6 will next be explained. This air brush is constructed similarly to the air brush shown in FIG. 1, but a slanting face 61 similar to the above slanting face is formed on the rear side face of the operating rod 6. This slanting face 61 is constructed in contact with the upper portion front face of an operating plate 13 internally mounted into the notch port 21.

The function of this air brush is similar to the above-mentioned function. After the operating rod 6 is pushed down by the timing stroke f2, a contact portion p of the slanting face 61 of this operating rod 6 and the operating plate 13 is transferred from the lower portion of this slanting face 61 to the upper portion. Further, at a time point at which the contact portion p is slid on this slanting face 61 by the length f1 of the slanting face, the pushing-moving operation of the operating rod 6 is stopped and the air supplied to the nozzle 2 is also approximately maximized.

The operating plate 13 is tilted backward by the rear face of this operating rod 6 by pulling-in the operating rod 6 from this state, and the needle is retreated through a chuck 14. Thus, the paint supplied to the nozzle 2 is adjusted and the line of an arbitrary thickness can be drawn.

In contrast to this, when the pushed operating rod 6 is returned, the contact portion p of the operating plate 13 and the operating rod 6 is moved downward from the upper end of the slanting face 61. When this contact portion p reaches a lower end portion 60*a*, the needle 3 is moved forward and the supply of the paint is first stopped. Next, the ejection of the air is stopped by lowering the contact portion p by the timing stroke f2 from the lower end portion 60*a*.

As mentioned above, the air brush functions similarly to the air brush shown in FIG. 1. However, since the contact portion p comes in face contact, the operating plate 13 and the slanting face 61 are smoothly slid when the operating rod 6 is pulled-in and pushed-in, thereby improving operability of the operating rod 6.

The air brush shown in FIG. 7 will next be explained. This air brush is also constructed similarly to the air brush shown in each of FIGS. 1 and 6, but is characterized in that slanting faces 62, 62' are formed on the front and rear faces of the operating rod 6.

Both these front and rear slanting faces 62, 62' are respectively constructed in contact with the front side edge 20*a* of the notch port 21 and the upper end of the operating plate 13 mounted within this notch port 21.

Figure 7:
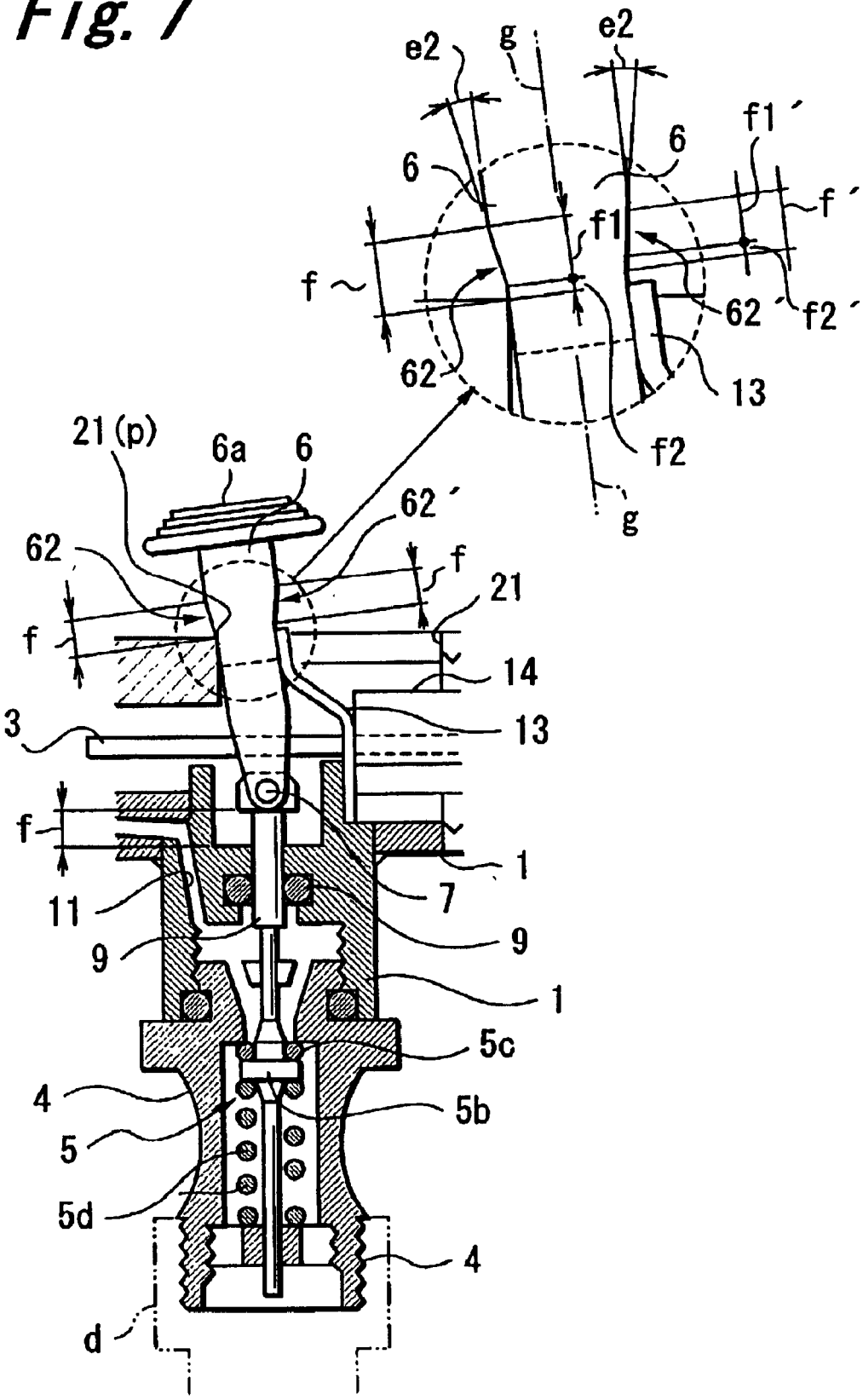
FIG. 7 is a longitudinal sectional view showing the operating rod portion of the air brush in which the slanting faces are arranged on the front side and the rear path side of the operating rod.

This air brush is constructed in a state in which the slanting faces 62, 62' are formed on both the front and rear faces of the operating rod 6, and the rear slanting face 62' is shifted to a position slightly higher than the front slanting face 62 (the partially enlarged view of FIG. 7).

Accordingly, when the above operating rod 6 is pushed down by the timing stroke f2, the air valve 5 is opened little by little in this pushing-down process and the air is gradually supplied toward the nozzle 2.

When the contact portion p of this operating rod 6 is transferred onto a lower end portion of the slanting face 62 and is slid onto both the slanting faces 62 by the stroke f1, the pushing-moving operation of the operating rod 6 is stopped. On the other hand, the rear slanting face 62' is constructed in a state in which the rear slanting face 62' is shifted slightly (by f2) upward from the slanting face 62 as mentioned above. Accordingly, the slanting face 62 on the front face side of the operating rod 6 is precedently lowered. Thereafter, the slanting face 62' abuts on an upper end edge portion of the operating plate 13 with the delay of a stroke f2', and this operating plate 13 is tilted backward.

Accordingly, when the operating rod 6 is pushed, the slanting face 62 on the front side first comes in contact with a front side edge 21(*p*) of the notch port. When the operating rod 6 is subsequently pushed down by the stroke f2', the rear slanting face 62' abuts on the edge of an upper end portion of the operating plate 13. When this abutting portion is transferred onto the slanting face 62', the distance of a backward tilting movement of the operating rod 6 becomes a distance provided by adding the lengths of both the front and rear slanting faces 62, 62'. Therefore, it is possible to increase the pulling amount of the needle 3 with respect to the pushing movement of the operating rod 6.

Further, when the operating rod 6 is pushed and moved, the operating rod 6 attains a state in which this operating rod 6 is pressed from forward and backward. Thus, in the above air brush, the operating rod 6 is very smoothly pushed and moved at the initial stage so that rattling of the operating plate 13, etc. can be also prevented. Further, it is possible to sufficiently secure the backward pulling stroke at the pushing-moving initial stage of the operating rod 6.

On the other hand, the state in which the operating rod 6 is pushed down by the stroke f as mentioned above is a state in which the air supplied to the nozzle 2 is approximately maximized. The operating plate 13 is tilted backward by the rear face of this operating rod 6 by pulling-in the operating rod 6 from this state, and the needle is retreated through the chuck 14. Thus, the line of an arbitrary thickness can be drawn by adjusting the paint supplied to the nozzle 2 by operating the operating rod 6.

As mentioned above, the air brush functions similarly to the case of upward shifting the rear slanting face 62' by forming a front side part of the tip edge of the operating rod 13 in an arc shape as a means for delaying timing in which the upper end of the operating rod 13 comes in contact with the slanting face 62' on the rear side.

It is arbitrary to set a difference in the positions of the slanting faces arranged on the front and rear faces of the operating rod, and both the front and rear slanting faces may be also arranged in conformity with the same level.

When the pushed operating rod 6 is originally returned, the operating rod 6 is returned to its original position and the finger is slowly separated from this operating rod 6. In this case, the contact portion p of the front side edge 20*a* of the notch port 21 and the operating rod 6, and the contact portion p of the operating plate 13 and the operating rod 6 are moved downward from the upper ends of both the slanting faces 62. When each of both the contact portions p reaches the lower end portion 60*a*, the needle 3 is moved forward and the supply of the paint is first stopped. Next, the ejection of the air is stopped by lowering the contact portion p by the timing stroke f2 from the lower end portion 60*a*.

In the above air brush, the slanting faces 62 are arranged on both the front and rear faces of the operating rod 6, and the blowing-out of the paint at the ejection initial stage is controlled by making both these slanting faces 62 come in contact with the front side plate 20*a* of the notch port 21 and the operating plate 13. Accordingly, this air brush has characteristics able to increase the front and rear moving amount of the needle in comparison with the pushing amount of the operating rod 6. The angle of the slanting face of the above operating rod 6 may be arbitrarily changed.

Figure 8A:
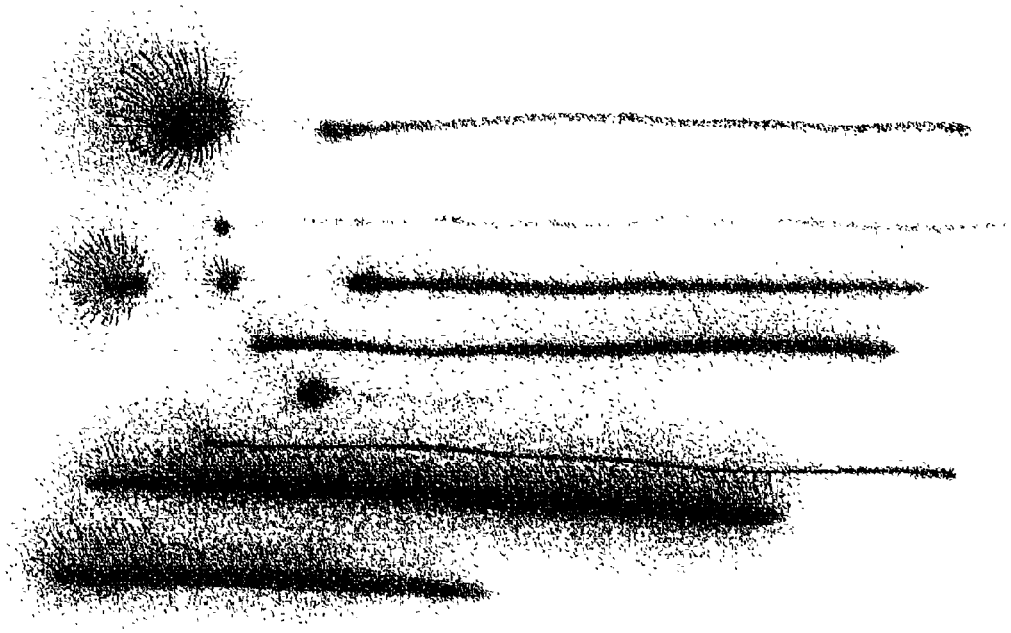
FIGS. 8A and 8B are views for comparing lines drawn by using the air brush of the present invention and the conventional air brush.

FIG. 8 is a view for comparing line drawings of the conventional air brush and the air brush of the present invention. These lines are drawn by a beginner almost never having the air brush. In FIG. 8A, the paint is blown at a stroke at the beginning of the blowing and starting dots are formed as in fireworks since no beginner knows the pushing degree of the operating rod. There is also a case in which the supply of the paint is too large and a pattern such as false eyelashes is formed. This pattern is a typical pattern of failures.

Figure 8B:
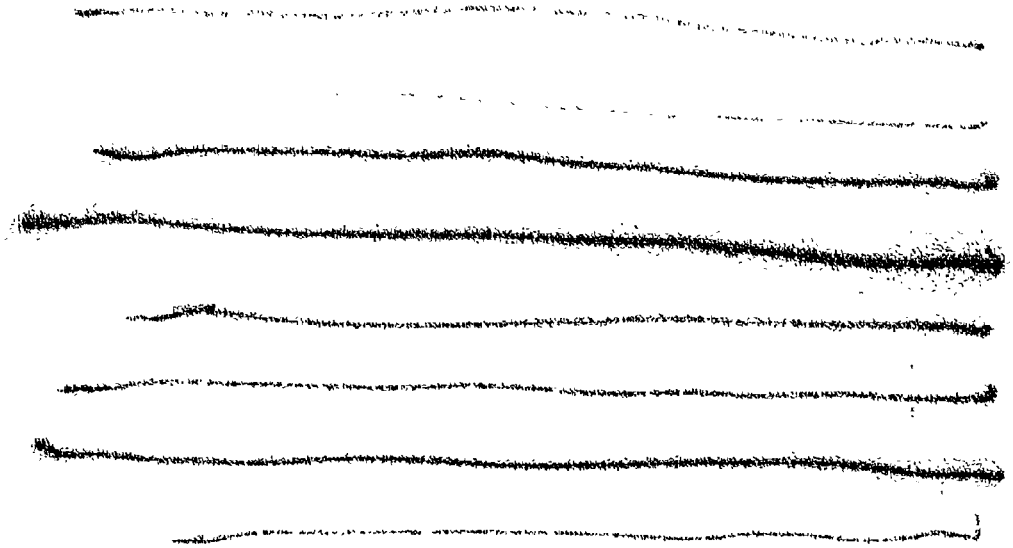

In FIG. 8B, the beginner drawing FIG. 8A writes lines just after the beginner has drawn FIG. 8A. The starting dots of the drawn lines are slightly thick, but comparatively beautiful lines are drawn.

It seems strange that such a different is caused even in the same beginner.

Figure 9A:
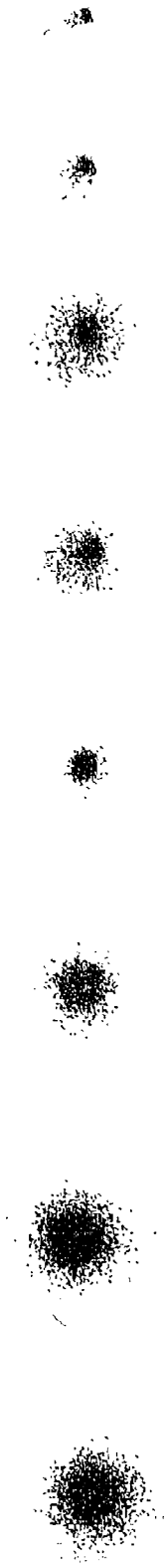
FIGS. 9A and 9B are views for comparing dots drawn by using the air brush of the present invention and the conventional air brush.

FIG. 9 is a view for comparing dot drawings of the conventional air brush and the air brush of the present invention. These dots are also drawn by the beginner. In FIG. 9A, additional paint is ejected together with the blowing-out of a dot so that the paint is scattered around the dot.

Figure 9B:
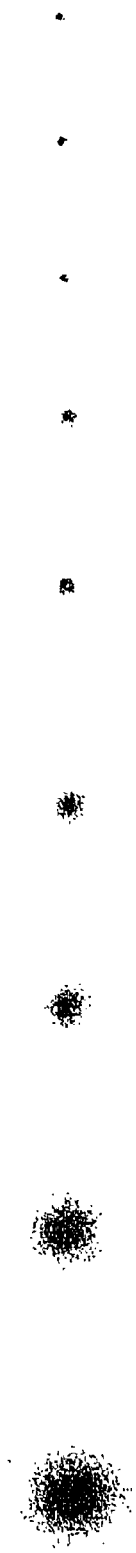

On the other hand, FIG. 9B shows the patterns of dots drawn by the same beginner by using the air brush of the present invention. There are almost no portions scattered around the dots, and patterns almost similar to those of a veteran are obtained.

Figure 10:
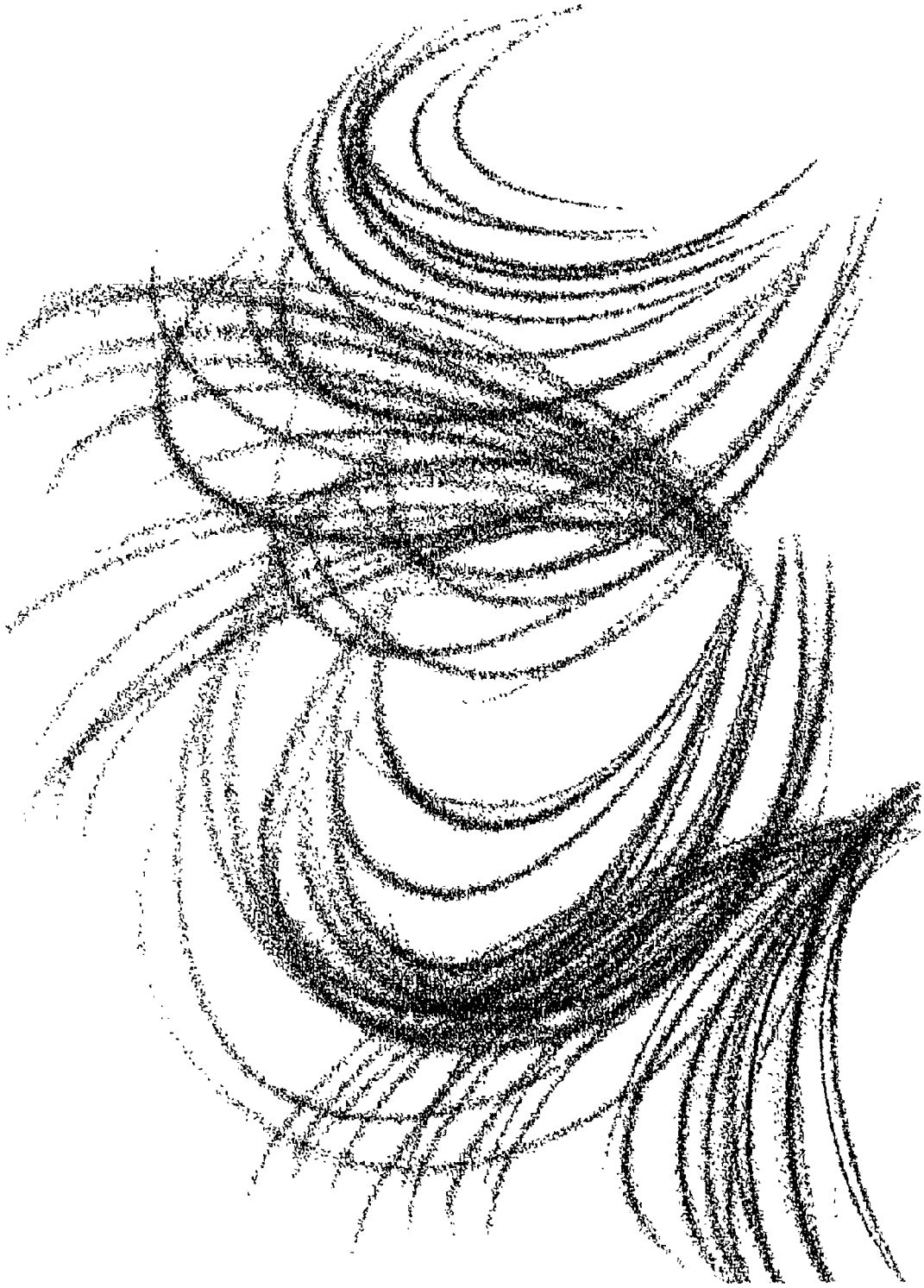
FIG. 10 shows curves drawn by the air brush of the present invention.
Figure 11:
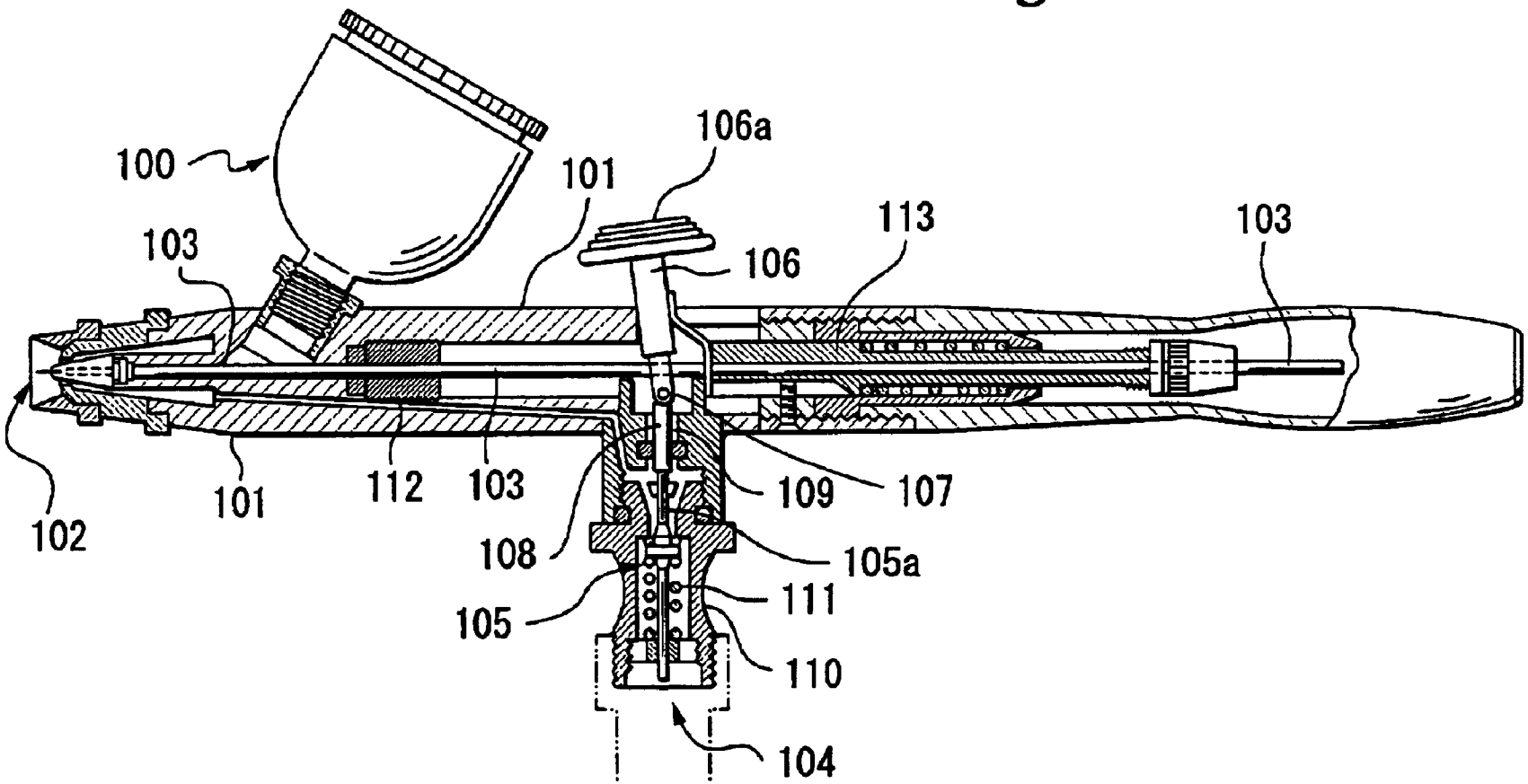
FIG. 11 is a longitudinal sectional view showing the conventional air brush.
Figure 12:
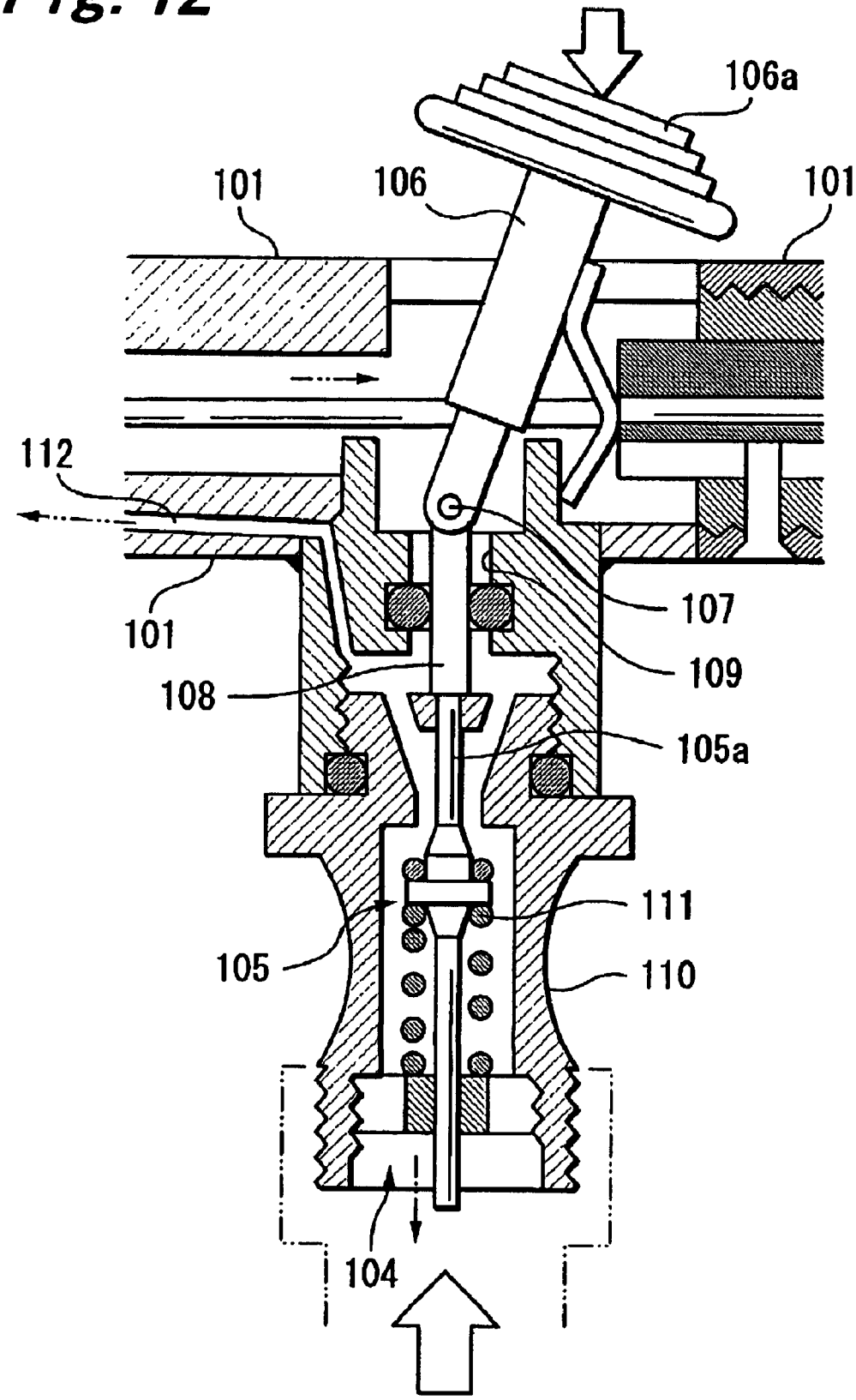
FIG. 12 is a longitudinal sectional view showing an operating rod portion of this air brush.

FIG. 10 shows lines drawn by a person accustomed to use the air brush. When these lines are seen well, the lines are naturally thickened from starting ends and are naturally thinned and are finely vanished at terminal ends. When a veteran uses the air brush of the present invention, the air brush becomes an air brush increasingly easily used so that the lines can be drawn at a level higher than that of the conventional air brush.

The angle, position, length, etc. of the slanting face arranged in the above operating rod may be arbitrarily changed. Further, the length of the above timing stroke may be also arbitrarily changed. The slanting face arranged in the operating rod may be formed in a plane such as the above slanting faces 60, 61, 62, but may be also constructed by a curve smoothly changed.

As explained above, the air brush of the present invention forms the slanting face therein projected while the slanting face is inclined from below to above on the front face side of the operating rod arranged in the air brush main body. Further, this slanting face abuts on the contact portion formed at the front side edge of the notch port of the air brush main body. Accordingly, in a range in which the slanting face of this operating rod and the contact portion arranged at the front side edge of the notch port are slid in contact with each other at the initial stage of the ejecting operation for pushing and moving the operating rod, the needle is retreated every small amount by utilizing this inclination and the air valve is opened little by little by pushing the air valve. Thus, it is possible to semi-automatically perform a series of operations at the initial stage of the ejection. As this result, the user can increase the amount of the air ejected from the nozzle and the amount of the paint supplied to the nozzle little by little from zero by only pushing the operating rod little by little at the initial stage of the operation. Thus, it is possible to avoid a failure in which the paint is ejected at a stroke at the initial stage of the spraying.

Accordingly, even a beginner can express the beautifulness of a line naturally enlarged from a starting point as the technique of a veteran in the conventional case. Further, the veteran can draw the line of a higher degree by using the technique of a high degree using the air brush easily used.

The air brush according to claim 2 forms a slanting face there in projected while the slanting face is inclined from below to above on the rear side face of the operating rod fitted into the notch port of the air brush main body. This slanting face abuts on an engaging body mounted into the notch port of the air brush main body.

Accordingly, when the slanting face on the rear side of the operating rod and the engaging body mounted into the notch port lie within a contact sliding range at the initial stage of an operation for pushing and moving the operating rod, the needle is retreated little by little by utilizing the inclination of this slanting face and the air valve is opened little by little by pushing the air valve.

Thus, the user can increase the air amount ejected from the nozzle and the amount of the paint supplied to the nozzle little by little from the state of zero by only slightly pushing the operating rod at the initial stage of the operation of the operating rod. Thus, it is possible to avoid a failure in which the paint is ejected at a stroke from the nozzle at the beginning of the blowing-out. Further, similar to the veteran, even a beginner can draw a beautiful line naturally enlarged from a starting point.

The air brush according to claim 3 forms slanting faces therein respectively projected while these slanting faces are inclined from below to above on the front and rear sides of the operating rod fitted into the notch port of the air brush main body. The contact portion of the slanting face on the front side of this operating rod and the front side edge of the notch port, and the engaging body fitted and mounted to the slanting face on the rear side of the operating rod and the notch port abut on each other.

Accordingly, the needle is retreated every small amount by utilizing the inclinations of both these front and rear slanting faces in a range in which the front side edge contact portion of the slanting face on the operating rod front side and the notch port, and the engaging body mounted to the slanting face on the operating rod rear side and the interior of the notch port come in contact with each other and are slid at the initial stage of the operation for pushing and moving the operating rod. Simultaneously, the air valve is opened every small amount by pushing the air valve little by little.

As this result, the user can increase the air amount ejected from the nozzle and the amount of the paint supplied to the nozzle little by little from the state of zero by only slightly pushing the operating rod at the initial stage of the operation of the operating rod. Thus, it is possible to avoid a failure in which the paint is ejected at a stroke from the nozzle at the beginning of the blowing-out. In addition to this, similar to a veteran, even a beginner can draw a beautiful line naturally enlarged from a starting point.

In the air brush according to claims 4–6, a timing stroke for making the ejection of the air precede the supply of the paint in the pushing of the operating rod, and delaying the ejection of the air with respect to the supply stoppage of the paint in the release of the pushed operating rod is arranged just below the slanting face in the above operating rod Accordingly, the blowing-out of the air precedes the supply of the paint in the range of the above timing stroke at the initial stage of the operation of the operating rod when the operating rod is pushed.

Thus, when the paint is supplied after the ejection of the air, it is possible to prevent the disadvantage that the paint supplied and collected in the nozzle is blown off at a stroke by the air and a failure is caused.

In contrast to this, when the blowing-out of the paint is stopped, the blowing-out of the air is stopped with a slight delay by the delay using the above timing stroke after the supply of the paint is stopped. As this result, no paint is left in the nozzle, and it is possible to prevent the paint left in the nozzle from being blown out at a stroke in the next use.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. An air brush constructed such that a needle for opening and closing a nozzle is inserted in an axial direction along a shaft core portion of an air brush main body having the nozzle at its tip and approximately formed in a long sleeve shape so as to be advanced and retreated, and a compressed air supplied to an interior of said air brush main body through an air valve is blown out of said nozzle, and an operating rod is fitted into said air brush main body from a notch port formed on an upper face of the air brush main body, and a pushing rod is connected to a lower end of the operating rod through a pivotal portion so as to be freely bent and is fitted into the air brush main body and is supported together with said operating rod so as to be freely vertically pushed and moved, and a lower end of this pushing rod and an upper end of a valve rod for opening and closing said air valve are opposed to each other, and the air valve is opened by pushing and moving the valve rod by a pushing operation of said operating rod, and the needle is retreated in the axial direction in cooperation with an engaging body mounted into said notch port by tilting the operating rod backward, and paint supplied to the nozzle is sprayed by blowing-out the compressed air;

wherein said operating rod forms a slanting face therein projected on a front face while the slanting face is inclined from below to above, and this slanting face abuts on a front side edge portion of the notch port of said air brush main body, and the air valve is opened every small amount and the needle is simultaneously retreated every small amount in a range in which the slanting face of the operating rod and a contact portion of the front side edge of the notch port come in contact with each other and are slid at an initial stage of an operation for pushing and moving said operating rod.

2. An air brush constructed such that a needle for opening and closing a nozzle is inserted in an axial direction along a shaft core portion of an air brush main body having the nozzle at its tip and approximately formed in a long sleeve shape so as to be advanced and retreated, and a compressed air supplied to an interior of said air brush main body through an air valve is blown out of said nozzle, and an operating rod is fitted into said air brush main body from a notch port formed on an upper face of the air brush main body, and a pushing rod is connected to a lower end of the operating rod through a pivotal portion so as to be freely bent and is fitted into the air brush main body and is supported together with said operating rod so as to be freely vertically pushed and moved, and a lower end of this pushing rod and an upper end of a valve rod for opening and closing said air valve are opposed to each other, and the air valve is opened by pushing and moving the valve rod by a pushing operation of said operating rod, and the needle is retreated in the axial direction in cooperation with an engaging body mounted into said notch port by tilting the operating rod backward, and paint supplied to the nozzle is sprayed by blowing-out the compressed air;

wherein said operating rod forms a slanting face therein projected on a rear side face while the slanting face is inclined from below to above, and this slanting face abuts on an engaging body mounted into the notch port of said air brush main body, and the air valve is opened every small amount and the needle is simultaneously retreated every small amount in a range in which the slanting face of the operating rod and the engaging body mounted into the notch port come in contact with each other and are slid at an initial stage of an operation for pushing and moving said operating rod.

3. An air brush constructed such that a needle for opening and closing a nozzle is inserted in an axial direction along a shaft core portion of an air brush main body having the nozzle at its tip and approximately formed in a long sleeve shape so as to be advanced and retreated, and a compressed air supplied to an interior of said air brush main body through an air valve is blown out of said nozzle, and an operating rod is fitted into said air brush main body from a notch port formed on an upper face of the air brush main body, and a pushing rod is connected to a lower end of the operating rod through a pivotal portion so as to be freely bent and is fitted into the air brush main body and is supported together with said operating rod so as to be freely vertically pushed and moved, and a lower end of this pushing rod and an upper end of a valve rod for opening and closing said air valve are opposed to each other, and the air valve is opened by pushing and moving the valve rod by a pushing operation of said operating rod, and the needle is retreated in the axial direction in cooperation, with an engaging body mounted into said notch port by tilting the operating rod backward, and paint supplied to the nozzle is sprayed by blowing-out the compressed air;

wherein slanting faces are respectively formed on front and rear face sides of said operating rod and are projected while the slanting faces are inclined from below to above, and these slanting faces respectively slidably abut on a front side edge of the notch port of said air brush main body and an engaging body mounted into the notch port of the air brush main body, and the air valve is opened every small amount and the needle is simultaneously retreated every small amount in a range in which both the front and rear slanting faces of the operating rod and both said contact portions come in contact with each other and are respectively slid at an initial stage of an operation for pushing and moving said operating rod.

4. An air brush according to claim 1, wherein a timing stroke for making ejection of the air precede the supply of the paint in the pushing of said operating rod, and delaying the ejection of the air with respect to a supply storage of the paint in release of the pushed operating rod is arranged below the slanting face of said operating rod.

5. An air brush according to claim 2, wherein a timing stroke for making ejection of the air precede the supply of the paint in the pushing of said operating rod, and delaying the ejection of the air with respect to a supply storage of the paint in release of the pushed operating rod is arranged below the slanting face of said operating rod.

6. An air brush according to claim 3, wherein a timing stroke for making ejection of the air precede the supply of the paint in the pushing of said operating rod, and delaying the ejection of the air with respect to a supply storage of the paint in release of the pushed operating rod is arranged below the slanting face of said operating rod.

* * * * *